US005796199A

United States Patent [19]

Charbonnel

[11] Patent Number: 5,796,199

[45] Date of Patent: Aug. 18, 1998

[54] PIVOTING VANE INTERNAL EXTREMITY BEARING

[75] Inventor: Jean-Louis Charbonnel, Boissise Le Roi, France

[73] Assignee: Societe Nationale D'Etude et de Construction De Moteurs D'Aviation "Snecma", Paris, France

[21] Appl. No.: 759,927

[22] Filed: Dec. 4, 1996

[30] Foreign Application Priority Data

Dec. 20, 1995 [FR] France ..... 95 15120

[51] Int. Cl.[6] ..... H02K 5/16

[52] U.S. Cl. ..... 310/90; 310/60 A; 415/150; 415/160

[58] Field of Search ..... 310/60 A, 90; 415/150, 160

[56] References Cited

U.S. PATENT DOCUMENTS

| | | | |
|---|---|---|---|
| 4,363,600 | 12/1982 | Thebert | 415/156 |
| 4,514,141 | 4/1985 | Marey | 415/160 |
| 4,604,030 | 8/1986 | Naudet | 415/126 |
| 4,861,228 | 8/1989 | Todman | 415/115 |
| 4,990,056 | 2/1991 | McClain et al. | 415/160 |
| 5,308,226 | 5/1994 | Venkatasubbu et al. | 415/160 |
| 5,324,165 | 6/1994 | Charbonnel et al. . | |
| 5,380,152 | 1/1995 | Sikorski et al. | 415/160 |
| 5,387,080 | 2/1995 | Bouhennicha et al. | 415/150 |
| 5,407,322 | 4/1995 | Charbonnel et al. | 415/160 |
| 5,517,817 | 5/1996 | Hines | 60/39 |
| 5,593,275 | 1/1997 | Venkatasubbu et al. | 415/160 |

*Primary Examiner*—Steven L. Stephan
*Assistant Examiner*—Elvin G. Enad
*Attorney, Agent, or Firm*—Oblon, Spivak, McClelland, Maier & Neustadt, P.C.

[57] ABSTRACT

Pivoting vane internal extremity bearing (1) whose internal extremities are connected by a linking ring (12). The bearing elements (18) connecting the internal extremity pivots (10) to the ring (12) are composed of a bush (19) prolonged by bearing necks (20) with a spin axis (X') parallel to that of the ring (12). The forces undergone by the vanes, which transversally move the pivots (10), do not cause any wear of the bush (19), but a rotation of the latter around the axis (X'). Application for turbine aero engine stator vanes.

3 Claims, 3 Drawing Sheets

PIVOTING VANE INTERNAL EXTREMITY BEARING

FIELD OF THE INVENTION

The invention concerns a pivoting vane internal extremity bearing.

BACKGROUND OF THE INVENTION

Modern turbo aero engines often include variable adjustment stator vanes, that is vanes in which it is possible to modify orientation via a pivoting movement, so as to modify the rectification of gases which are provoked and optimize the performances of the engine at the various speeds of the latter. As can be seen on FIG. 1, the variable adjustment vanes 1 are disposed in circular stages which alternate with the stages, also circular, of mobile vanes 2 fixed to the rotor 3, the vanes 1 have an external extremity pivot 4 engaged in a bearing 5 of the stator 6 and projecting externally so as to finish at a head 7 held by a control lever 8, and the control levers 8 the vanes 1 of a given stage are joined at their other extremity to a control ring 9 which surrounds the stator 6: the rotation of the control ring 9 around its axis thus tilts the levers 8 and pivots the vanes 1.

The internal extremity of the vanes 1 includes an internal pivot 10 engaged in an internal bearing 11 and having in this traditional conception the shape of a cylindrical bush and housed in a linking ring 12 common to all the vanes 1 of a given stage and whose role is to reinforce the mounting of the vanes 1 whilst contributing in delimiting the flow vein of the gases 13 with platforms 14 of the mobile vanes 2 and in carrying a labyrinth gasket 15 with the stator 6.

The internal bearings 11 often have an approximately cylindrical hollow bush made of an antifriction material enabling the internal pivots 10 to rotate easily. However, the internal bearings 11 need to be replaced frequently as a result of the aerodynamic forces exerted on the vanes 1 which warps them and results in moving the linking ring 12: the internal pivots 10 are then orientated obliquely in the internal bearings II and wear them by widening them. In fact, the internal bearings 11 are mounted by being clamped in the linking ring 12 and adjusted so as to slide around the internal pivot 10. Thus, the wear almost results in an immediate significant modification of the adjustment.

It has already been suggested to replace the cylindrical bearings with pot type joint bearings as in the French patent 2 599 785 with the advantage that the bearings then tilt in their housing of the linking ring 12 at the same time as the pivots. However, it is inappropriate to use this device as the spherical housings for the bearings are more difficult to embody.

SUMMARY OF THE INVENTION

The invention is based on the notion that wear of the bearing element can be anticipated and providing it with the freedom of movement of a pot type joint. In fact, it was observed that the rectifier composed of the vanes 1 and the linking ring 12 had a weak inertia of the unit rotating around the axis X of the engine and the linking ring 12, whereas its inertia in translation along this axis was much higher, which explains that the movements of the internal pivots 10 and the wear they cause to the bearing elements are much more significant in a transverse direction than in a longitudinal direction.

The bearing of the invention thus has one particular characteristic in that it can only rotate in the linking ring when the pivot it bears makes it rotate transversally around an axis parallel to the axis X of the engine. To sum up, the invention concerns a pivoting vane internal extremity bearing engaged in a linking ring of the pivoting vanes of a given stage and including a bush surrounding the pivot, wherein it includes a bearing neck rotating in a perforation of the ring whose axis is parallel to the axis of the ring, and wherein the bush integral with the bearing neck is free to play in the ring.

BRIEF DESCRIPTION OF THE DRAWINGS

There now follows a more detailed description of the invention with reference to the following figures concerning a preferred embodiment of the invention.

DETAILED DESCRIPTION OF THE PREFERRED EMBODIMENTS

Figure 1:
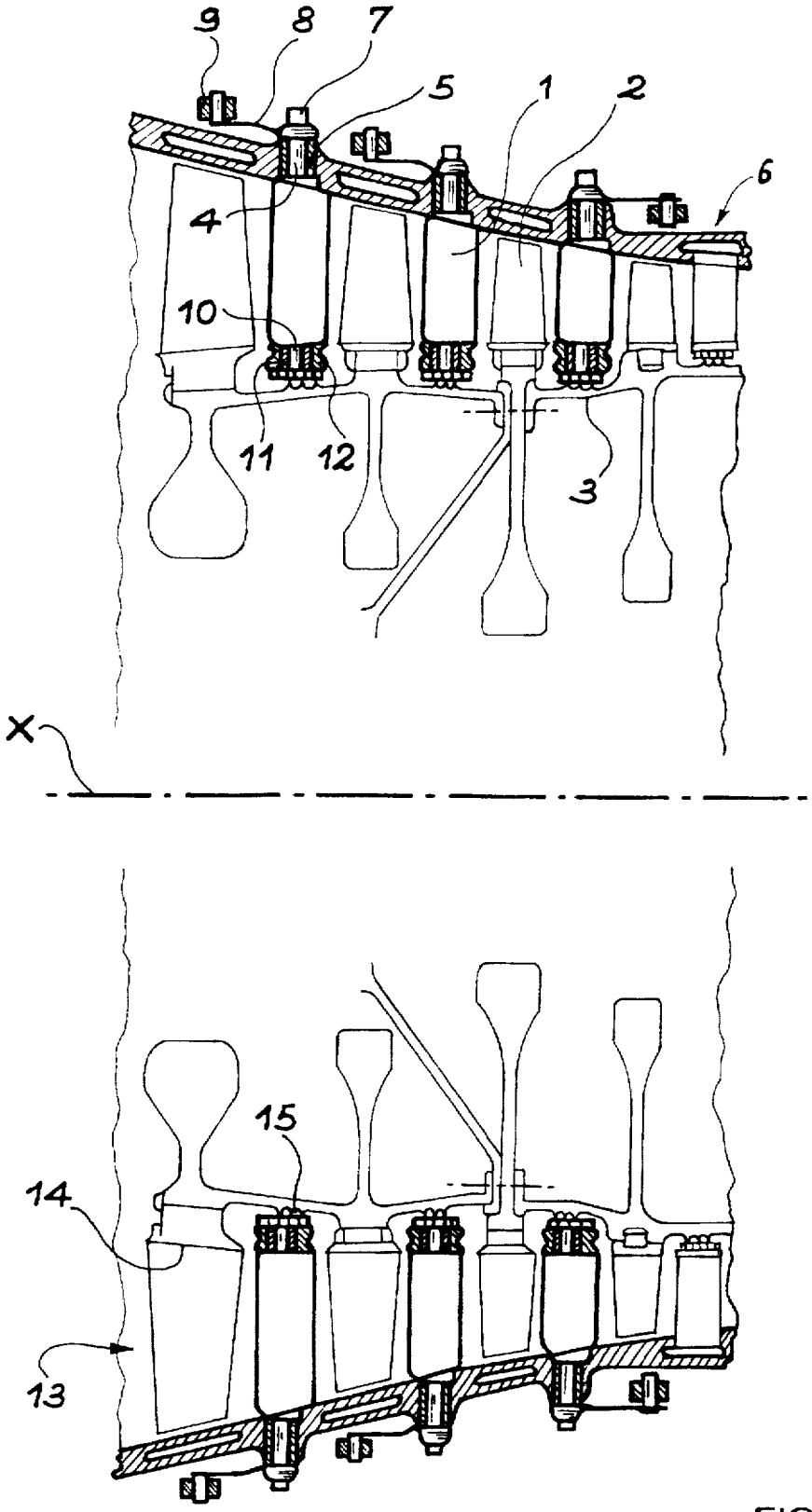
FIG. 1 PRIOR ART
FIG. 1, already described, illustrates the location for using the invention in a turbo aero engine and a conception of the prior art.
Figure 2:
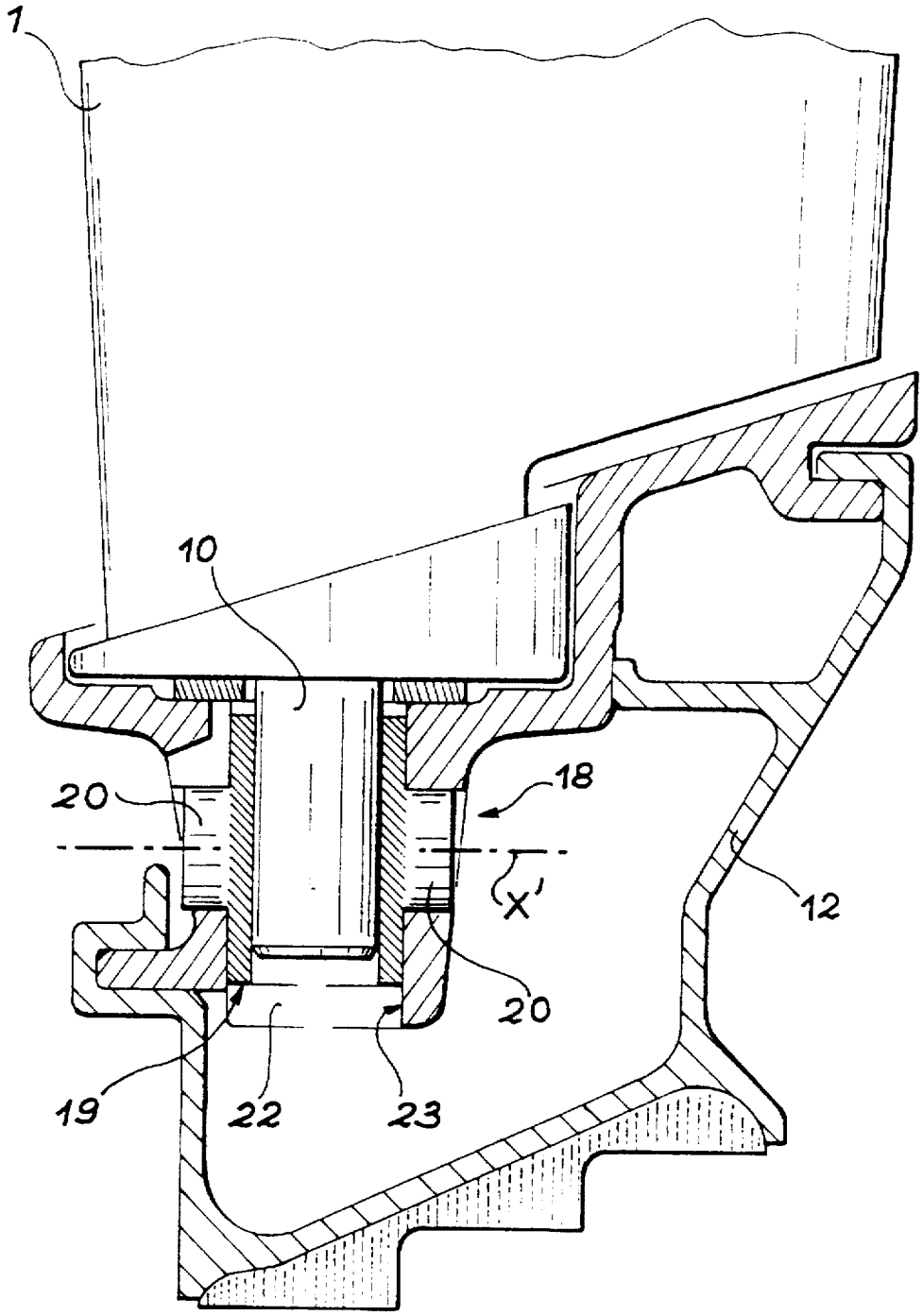
FIG. 2 shows a complete bearing of the invention.
Figure 3:
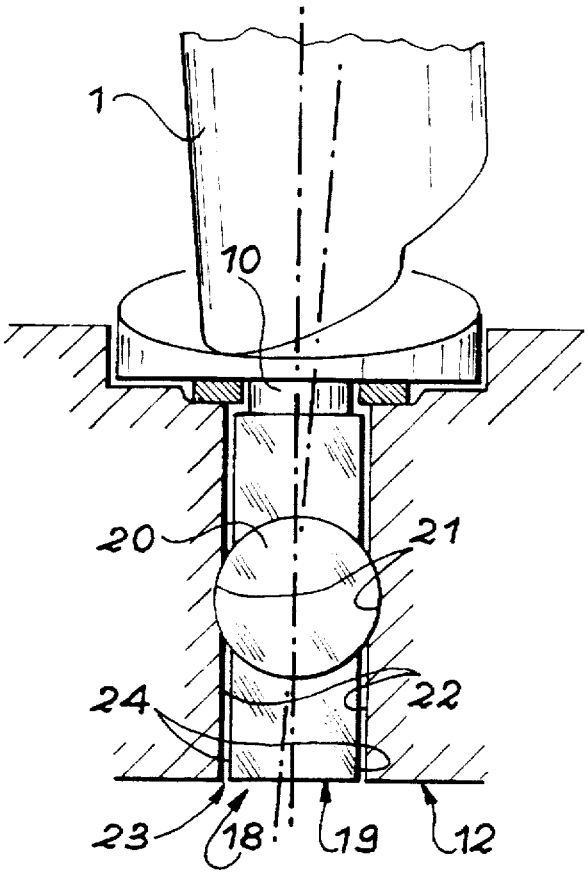
FIG. 3 represents the bearings viewed in a longitudinal direction.
Figure 4:
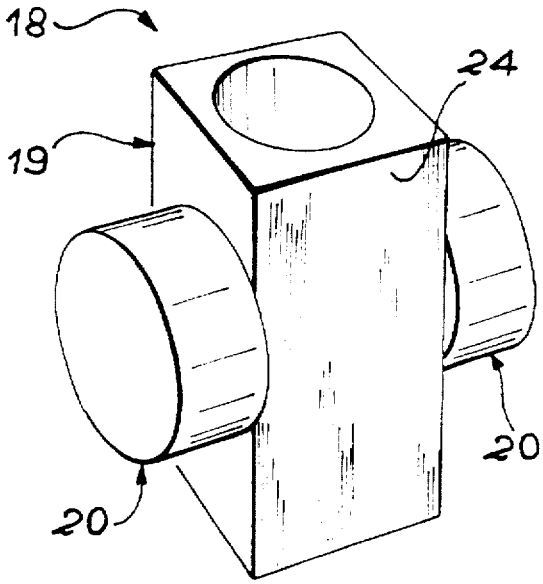
FIG. 4 shows a perspective view of the bearing element.

FIG. 2 shows the vane 1, its internal pivot 10 and the linking ring 12. The bearing element 18, that is the one which connects each of the internal pivots 10 to the linking ring 12, is composed of a cylindrical bush 19 like the bush 11, and two extending bearing neck portions 20 situated on each side of the bush 19 which forms a single piece with said portions. The bearing neck portions 20 thus have a common spin axis X' parallel to the axis X of the engine and the linking ring 12. As illustrated on FIGS. 2 and 3, the bearing neck portions 20 are engaged in the bore portions 21 of the linking ring 12 so as to be able to rotate freely around this axis X'. These portions 21 are fitted in recesses on two flat faces 22 of the linking ring 12 and a radial pit extends between them, the width of said pit being slightly larger than that of the bush 19. As a result, the latter can play in the pit 23 until its lateral faces 24 touch the flat faces 22 : a limited rotation of the bearing element 18 is thus possible with respect to the linking ring 12 according to the movements inflicted on it by the internal pivots 10 but without these movements being able to wear the inside of the bush 19.

What is claimed is:

1. A bearing for journalling a pivot at a radially internal extremity of a pivoting stator vane, the bearing being accommodated in a ring extending around a central axis linking a plurality of pivoting vanes together, wherein the bearing includes a bush surrounding the pivot and an axle integral with the bush, the axle being rotatable in a perforation in the ring which extends parallel to the central axis and the bush being free to rotate inside the ring.

2. The bearing of claim 1, wherein the axle includes two portions, the bush being located between said portions.

3. The bearing of claim 2, wherein the bush is located in a recess of the ring, the recess being defined by stop faces which limit an allowed rotation range for the bush.

* * * * *